US009555989B2

(12) United States Patent
Hayakawa et al.

(10) Patent No.: US 9,555,989 B2
(45) Date of Patent: Jan. 31, 2017

(54) IMAGE FORMING APPARATUS

(71) Applicant: FUJI XEROX CO., LTD., Tokyo (JP)

(72) Inventors: Yuji Hayakawa, Kanagawa (JP); Katsunori Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/939,412

(22) Filed: Nov. 12, 2015

(65) Prior Publication Data

US 2016/0368723 A1 Dec. 22, 2016

(30) Foreign Application Priority Data

Jun. 22, 2015 (JP) ..... 2015-124435

(51) Int. Cl.

| | |
|---|---|
| ***B65H 3/44*** | (2006.01) |
| ***B65H 5/26*** | (2006.01) |
| ***B65H 1/04*** | (2006.01) |
| ***B65H 5/06*** | (2006.01) |
| ***G03G 21/16*** | (2006.01) |

(52) U.S. Cl.

CPC *B65H 5/26* (2013.01); *B65H 1/04* (2013.01); *B65H 3/44* (2013.01); *B65H 5/062* (2013.01); *G03G 21/1633* (2013.01); *G03G 21/1638* (2013.01); *G03G 21/1695* (2013.01); *B65H 2402/45* (2013.01)

(58) Field of Classification Search

CPC ..... B65H 3/44; B65H 5/26; B65H 5/38; G03G 21/1623; G03G 21/1633; G03G 21/1638

See application file for complete search history.

(56) References Cited

U.S. PATENT DOCUMENTS

| | | | | |
|---|---|---|---|---|
| 5,307,116 | A * | 4/1994 | Ikunami | G03G 15/70 271/263 |
| 7,979,002 | B2 * | 7/2011 | Nishikata | B65H 5/062 399/110 |
| 8,478,165 | B2 * | 7/2013 | Somemiya | G03G 21/1647 399/124 |
| 8,521,063 | B2 * | 8/2013 | Saito | G03G 21/1633 399/121 |
| 8,811,857 | B2 * | 8/2014 | Fukunaga | B65H 5/00 271/264 |
| 2012/0099896 | A1 * | 4/2012 | Kamano | G03G 15/161 399/121 |

FOREIGN PATENT DOCUMENTS

JP 2003176059 A 6/2003

* cited by examiner

*Primary Examiner* — Luis A Gonzalez
(74) *Attorney, Agent, or Firm* — Oliff PLC

(57) ABSTRACT

An image forming apparatus includes a first sheet-transport-path portion that allows a sheet to be transported toward an image forming unit included in an image forming apparatus body; a second sheet-transport-path portion that allows a sheet fed from sheet trays, holding sheets and vertically stacked in multiple rows one above another, to be transported toward the image forming apparatus body; and an opening-closing member supported so as to be movable around a rotation axis between an open position, in which the opening-closing member collectively opens the first sheet-transport-path portion and the second sheet-transport-path portion to an outside, and a closed position, in which the opening-closing member collectively closes the first sheet-transport-path portion and the second sheet-transport-path portion.

7 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2015-124435 filed Jun. 22, 2015.

BACKGROUND

Technical Field

The present invention relates to image forming apparatuses.

SUMMARY

In order to address the above-described problem, an image forming apparatus according to an aspect of the invention includes a first sheet-transport-path portion that allows a sheet to be transported toward an image forming unit included in an image forming apparatus body; a second sheet-transport-path portion that allows a sheet fed from sheet trays, holding sheets and vertically stacked in multiple rows one above another, to be transported toward the image forming apparatus body; and an opening-closing member supported so as to be movable around a rotation axis between an open position, in which the opening-closing member collectively opens the first sheet-transport-path portion and the second sheet-transport-path portion to an outside, and a closed position, in which the opening-closing member collectively closes the first sheet-transport-path portion and the second sheet-transport-path portion.

BRIEF DESCRIPTION OF THE DRAWINGS

Exemplary embodiments of the present invention will be described in detail based on the following figures, wherein.

DETAILED DESCRIPTION

Figure 1:
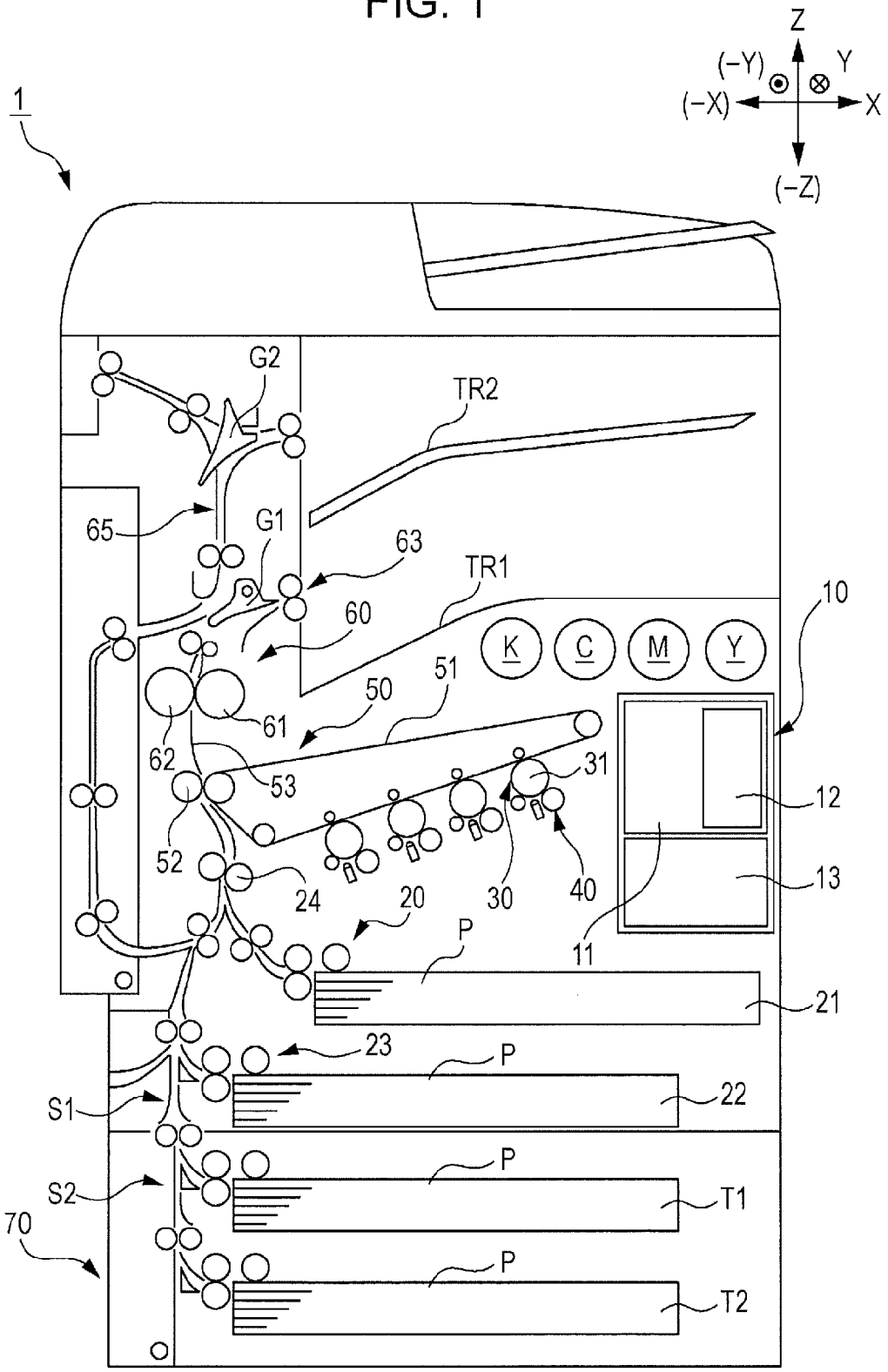
FIG. 1 is a cross-sectional schematic diagram of an internal configuration of an image forming apparatus.

Referring now to the drawings, the invention is specifically described in detail below using embodiments or specific examples. The invention, however, is not limited to these embodiments or specific examples.

In the following description referring to the drawings, it is to be understood that the drawings are schematic and have dimensional ratios or other properties that are different from the actual ones. For ease of understanding, illustrations of components other than necessary for description are appropriately omitted.

(1) Entire Configuration and Operation of Image Forming Apparatus

FIG. 1 is a vertical sectional view of the internal configuration of an image forming apparatus 1.

Referring now to the drawings, the entire configuration and the operation of the image forming apparatus 1 are described below.

The image forming apparatus 1 includes a controlling device 10, a sheet-feeding device 20, photoconductor units 30, developing devices 40, a transfer device 50, a fixing device 60, and a sheet transporting device 70. The image forming apparatus 1 includes a paper output tray portion T on the upper surface (on the Z side) of the image forming apparatus 1. The paper output tray portion T receives sheets on which images have been recorded.

The controlling device 10 includes a controller 11, which controls the operation of the image forming apparatus 1, an image processing unit 12, whose operation is controlled by the controller 11, and a power supply device 13. The power supply device 13 applies voltages to components such as the photoconductor units 30, the developing devices 40, and the transfer device 50.

The image processing unit 12 converts print information input by an external information transmitting device (such as a personal computer) into image data for forming a latent image and outputs a driving signal to an exposure device LH at a predetermined time.

The body of the image forming apparatus 1 has a sheet-feeding device 20, including two-stage sheet trays 21 and 22, at a bottom portion. Sheets P stacked on the sheet trays 21 and 22 are aligned widthwise with a regulating board (not illustrated). The sheets P are drawn forward (in the −X direction) by a sheet drawing portion 23 one by one from the top.

Each sheet P picked up by the sheet drawing portion 23 is transported to a nip of a pair of registration rollers 24 through a first sheet-transport-path portion S1.

The sheet transporting device 70 is connected to the lower side of the sheet-feeding device 20. The sheet transporting device 70 forms a tray module TM including multiple sheet trays T1 and T2 vertically stacked in multiple rows (two rows in the embodiment) one on top of the other, each tray holding the sheets P. The sheets P that have been fed from the sheet trays T1 and T2 are transported through the second sheet-transport-path portion S2 and the first sheet-transport-path portion S1 to the nip between the pair of registration rollers 24.

Each of the photoconductor units 30 includes a photoconductor drum 31, which is driven to rotate, on the upper side (Z side) of the sheet-feeding device 20. The photoconductor drums 31 are arranged side by side. Each of the photoconductor drum 31 receives, on its surface, a toner image of yellow (Y), magenta (M), cyan (C), or black (K), from the corresponding developing device 40.

The toner images with the corresponding colors formed on the photoconductor drums 31 of the photoconductor units 30 are sequentially electrostatically transferred (first-transferred) onto an intermediate transfer belt 51 of the transfer device 50, so that a superposed toner image in which toners of different colors are superposed one on another is formed. The superposed toner image on the intermediate transfer belt 51 is collectively transferred by second transfer rollers 52 to a sheet P that has been fed by the pair of registration rollers 24 and guided by a transport guide 53.

The fixing device 60 includes a pair of a heating module 61 and a pressing module 62, which are in pressure contact with each other and form a pressure contact area serving as a fixing nip or a fixing area.

A sheet P to which the superposed toner image has been collectively transferred by the transfer device 50 is transported to the fixing nip of the fixing device 60 through the transport guide 53 in the state where the toner image remains unfixed to the sheet P. At the fixing nip, the toner image is fixed by the pair of the heating module 61 and the pressing module 62 with the functions of the pressure and the heat.

The sheet P carrying the fixed toner image is guided by a switch gate G1 and discharged through a pair of first output rollers 63 to the paper output tray portion TR1 on the upper surface of the image forming apparatus 1. In the case where the sheep P is to be reversed for double-sided printing or discharged with its image-carrying side up, the sheet P is guided to a transport path 65 at the switch gate G1 so as to be directed to the opposite direction.

(2) Configuration and Operation of Sheet Transporting Device

Figure 2:
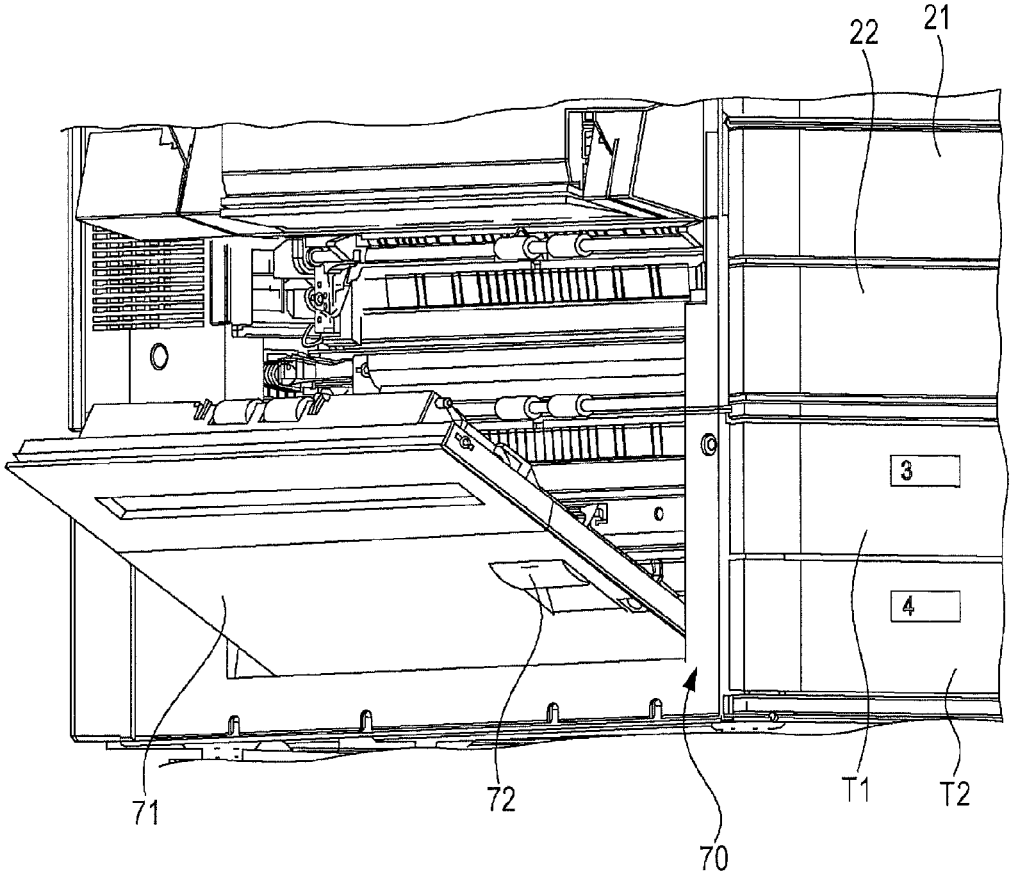
FIG. 2 is a perspective view of the image forming apparatus in the state where an opening-closing member of a sheet transporting device is open.
Figure 3:
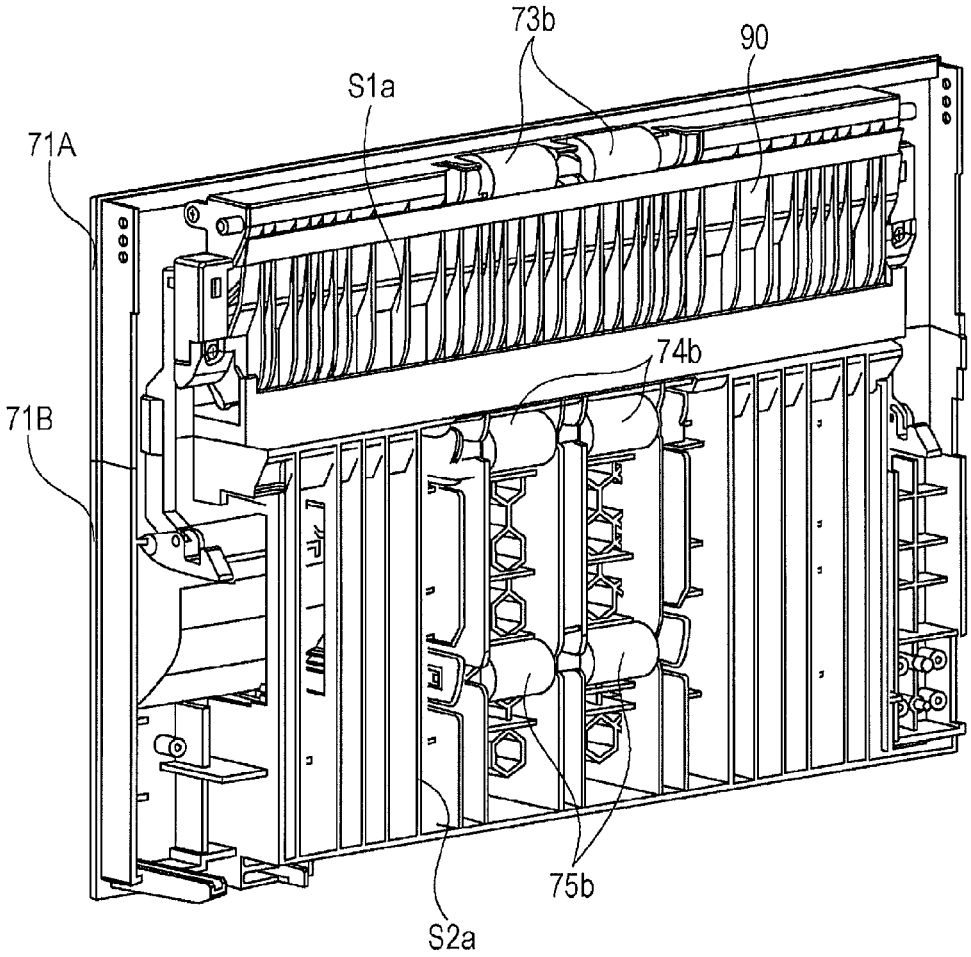
FIG. 3 is a perspective view of a first sheet-transport-path portion and a second sheet-transport-path portion on the inner surface side of the opening-closing member.
Figure 4:
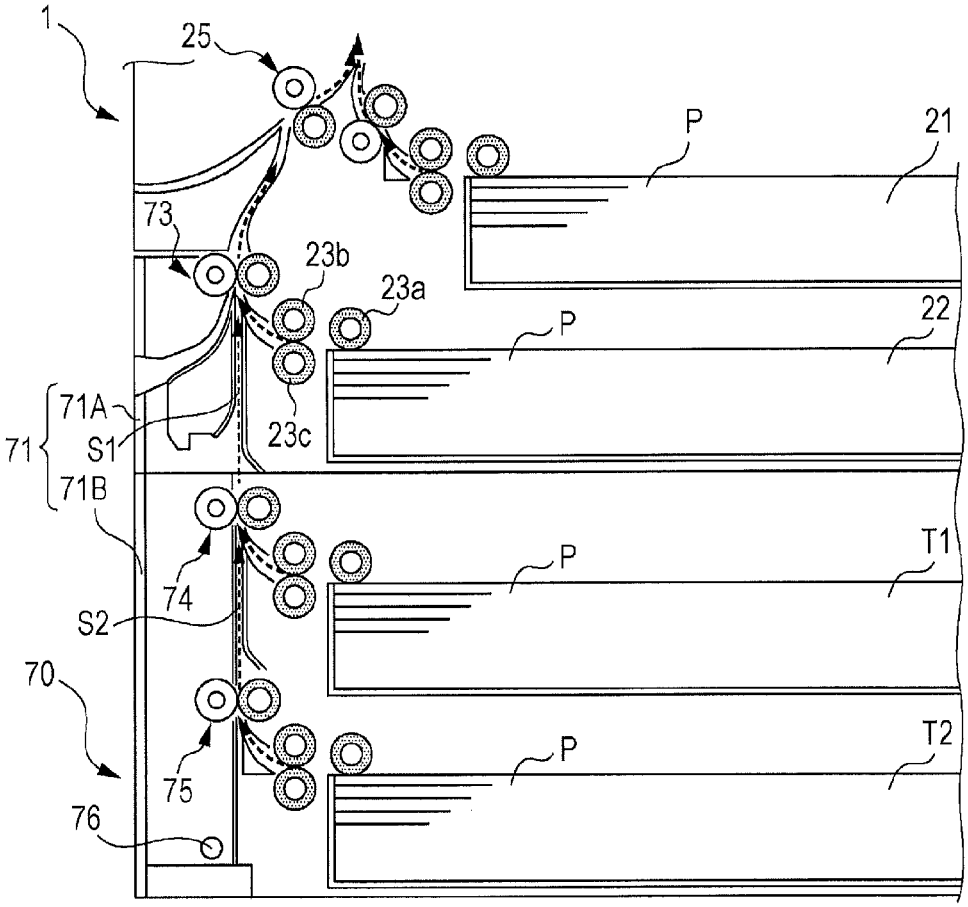
FIG. 4 is a vertical sectional schematic diagram of the configuration of the first sheet-transport-path portion and the second sheet-transport-path portion and sheet transportation along the first sheet-transport-path portion and the second sheet-transport-path portion.

FIG. 2 is a perspective view of the image forming apparatus 1 in the state where an opening-closing member 71 of the sheet transporting device 70 is open. FIG. 3 is a perspective view of the first sheet-transport-path portion S1 and the second sheet-transport-path portion S2 on the inner surface side of the opening-closing member 71. FIG. 4 is a vertical sectional schematic diagram of the configuration of the first sheet-transport-path portion S1 and the second sheet-transport-path portion S2 and sheet transportation along the first sheet-transport-path portion S1 and the second sheet-transport-path portion S2.

Referring now to the drawings, the configuration of a sheet transport unit including the sheet transporting device 70 of the image forming apparatus 1 and the sheet transportation of the sheet transport unit are described below.

(2.1) Configuration of Sheet Transport Unit

As illustrated in FIG. 2, the sheet transporting device 70 forms the tray module TM including the sheet trays T1 and T2 vertically stacked in two rows one on top of the other. The sheet transporting device 70 is connected to the lower side of the sheet-feeding device 20 of the image forming apparatus 1.

The opening-closing member 71 is disposed on the left side of the sheet transporting device 70 (−X side in FIG. 1). The opening-closing member 71 is rotatably supported so as to be openably and closably switched between an open position, in which the opening-closing member 71 collectively opens the first sheet-transport-path portion S1 and the second sheet-transport-path portion S2 to the outside, and a closed position, in which the opening-closing member 71 collectively closes the first sheet-transport-path portion S1 and the second sheet-transport-path portion S2.

An operating lever 72, which is rotatably operable, is disposed on the opening-closing member 71. Operating the operating lever 72 disengages an engaging portion, described below.

As illustrated in FIG. 3, a guide member 90 is movably supported on the inner surface side of the opening-closing member 71. The guide member 90 forms the first sheet-transport-path portion S1, serving as a sheet-transport-path portion for sheets fed from the lower sheet tray 22 of the sheet-feeding device 20 of the body of the image forming apparatus 1. In addition, a sheet guide surface S2*a* of the second sheet-transport-path portion S2 is located upstream of the first sheet-transport-path portion S1 in the direction in which sheets are transported. The sheet guide surface S2*a* serves as a transport path for sheets fed from the tray module TM.

The opening-closing member 71 is divided into a first opening-closing member 71A, which supports the guide member 90, and a second opening-closing member 71B, on which the second sheet-transport-path portion S2 is disposed, at the position drawn with dotted lines in FIG. 3. The first opening-closing member 71A and the second opening-closing member 71B are fastened together with fastening members such as screws, not illustrated. This configuration allows, depending on the configuration of the body of the image forming apparatus 1, the opening-closing member 71 of the sheet transporting device 70 to be modified so as to only include the second opening-closing member 71B, which supports the second sheet-transport-path portion S2.

The guide member 90 includes a rib-shaped sheet guide surface S1*a* of the first sheet-transport-path portion S1 that guides sheets P fed from the sheet trays T1 and T2 and transported through the second sheet-transport-path portion S2.

Pinch rollers 73*b* are rotatably supported on the downstream of the sheet guide surface S1*a* in the direction in which sheets are transported. The pinch rollers 73*b* are urged and supported so as to protrude from the sheet guide surface S1*a*.

The pinch rollers 73*b* are rotatably pressed against driving rollers 73*a*, constituting pairs of transport rollers 73. The pinch rollers 73*b* transport, toward the pair of registration rollers 24, the sheets P that have been fed from the lower sheet tray 22 of the sheet-feeding device 20 and from the sheet trays T1 and T2 of the sheet transporting device 70.

On the second sheet-transport-path portion S2, the sheet guide surface S2*a* is formed in a rib-shaped form. The sheet guide surface S2*a* guides the sheets P fed from the sheet trays T1 and T2.

Pinch rollers 74*b* and 75*b* are rotatably supported on the sheet guide surface S2*a*. The pinch rollers 74*b* and 75*b* are urged and supported so as to protrude from the sheet guide surface S2*a*.

The pinch rollers 74*b* and 75*b* are rotatably pressed against driving rollers 74*a* and 75*a*, constituting pairs of transport rollers 74 and 75. The pinch rollers 74*b* and 75*b* transport the sheets P fed from the sheet trays T1 and T2 toward the first sheet-transport-path portion S1.

(2.2) Sheet-Transport-Path Portion

As illustrated in FIG. 4, the body of the image forming apparatus 1 includes the sheet trays 21 and 22 in the sheet-feeding device 20. The sheet transporting device 70 including the sheet trays T1 and T2 is connected to the lower side of the sheet-feeding device 20. Sheets P stacked on the sheet trays 21, 22, T1, and T2 are drawn from the sheet trays 21, 22, T1, and T2 by the corresponding sheet drawing portions 23.

Each sheet drawing portion 23 includes a pickup roller 23*a*, a feed roller 23*b*, and a retard roller 23*c*. The sheets P stacked on the sheet trays are picked up by rotation of the pickup rollers 23*a*, separated one from the other by the reversing retard rollers 23*c*, and transported to the pairs of transport rollers 73, 74, and 75 by the feed rollers 23*b*.

The sheets P drawn from the lower sheet tray T2 of the sheet transporting device 70 are transported by the pairs of transport rollers 74 and 75 through the second sheet-transport-path portion S2 toward the first sheet-transport-path portion S1. The sheets P drawn from the upper sheet tray T1 of the sheet transporting device 70 are transported by the pair of transport rollers 74 toward the first sheet-transport-path portion S1.

The sheets P drawn from the lower sheet tray 22 of the sheet-feeding device 20 are transported by the pair of transport rollers 73 to a pair of transport rollers 25 disposed on the body of the image forming apparatus 1.

The sheets P drawn from the sheet trays 21, 22, T1, and T2 are transported to a second transfer portion while being positionally adjusted by the pair of registration rollers 24 and subjected to transfer of toner images by the second transfer rollers 52 (see FIG. 1).

(2.3) Opening of Sheet-Transport-Path Portion

In the sheet-transport-path portion having the above-described configuration, a rotation shaft 76 around which the opening-closing member 71 rotates is located at the upstream end portion of the second sheet-transport-path portion S2 in the direction in which sheets are transported.

Figure 7:
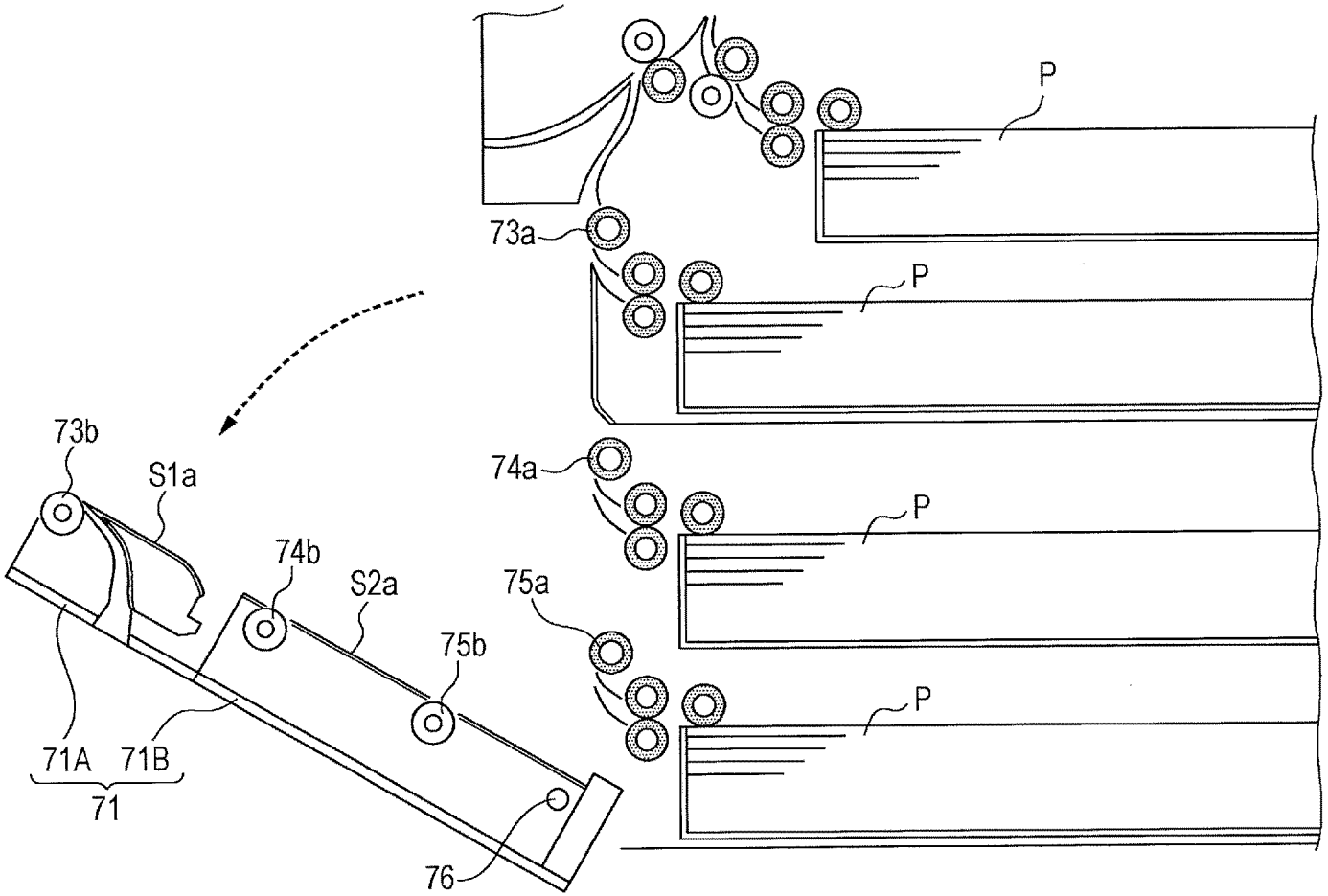
FIG. 7 is a vertical sectional schematic diagram of the first sheet-transport-path portion and the second sheet-transport-path portion that are in an open state.

Thus, when the opening-closing member 71 is rotated around the rotation shaft 76 to the open position, the first sheet-transport-path portion S1 for sheets from the lower sheet tray 22 of the sheet-feeding device 20 and the second sheet-transport-path portion S2 for sheets from the sheet transporting device 70 are collectively opened, thereby allowing removal of jammed sheets (see FIG. 7).

(3) Jammed-Sheet Removal Operation

Figure 5:
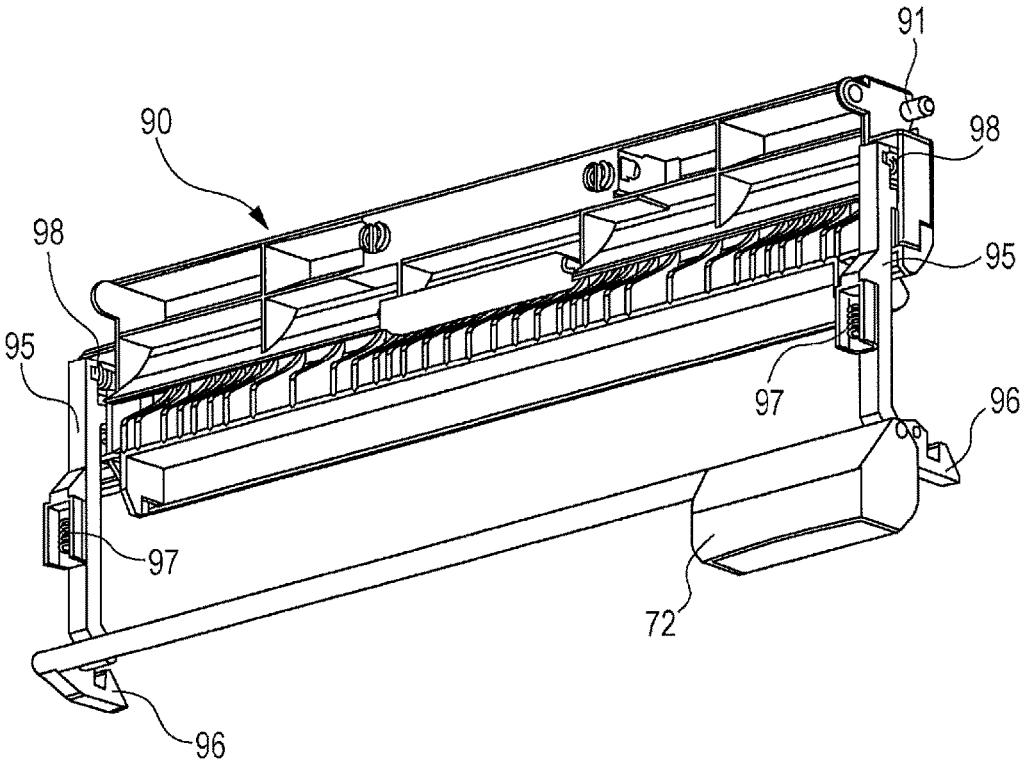
FIG. 5 is a perspective view of the configuration of a guide member and a link member when viewed from the inner surface side of the opening-closing member.
Figure 6:
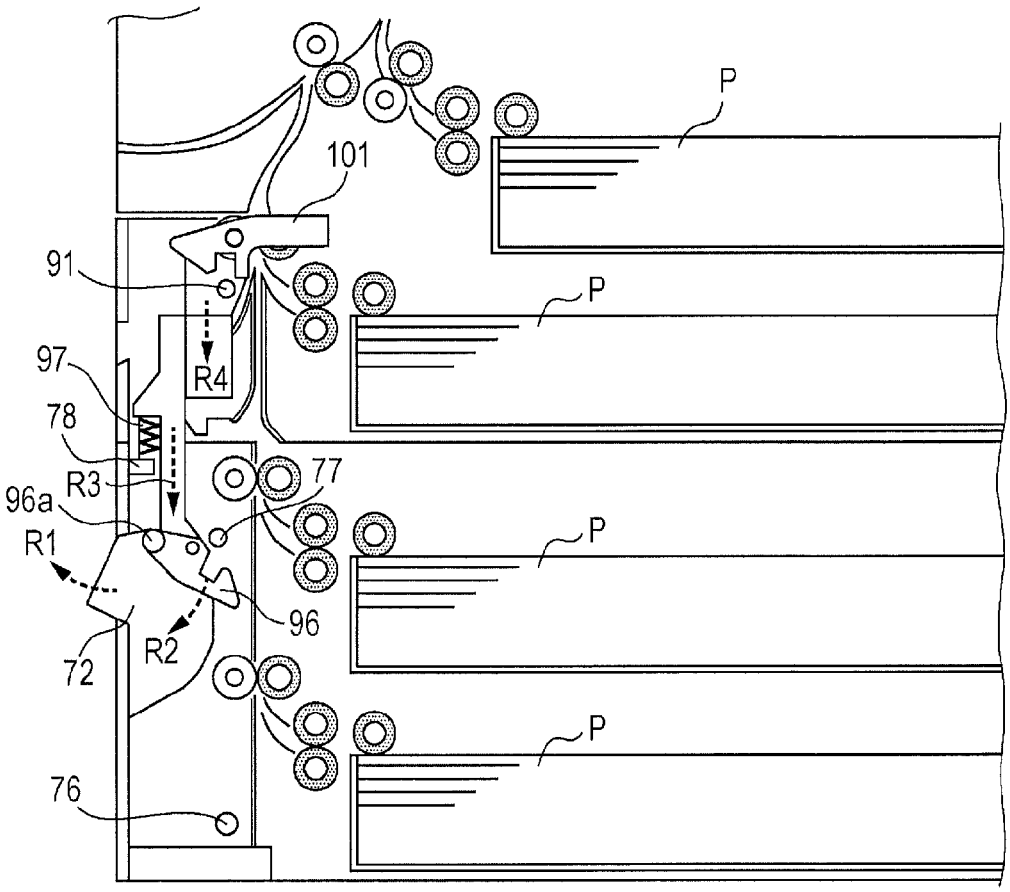
FIG. 6 is a cross-sectional schematic diagram of the first sheet-transport-path portion and the second sheet-transport-path portion that are in the state of being disengaged from the body of the image forming apparatus as a result of operating an operating lever of the opening-closing member.
Figure 8:
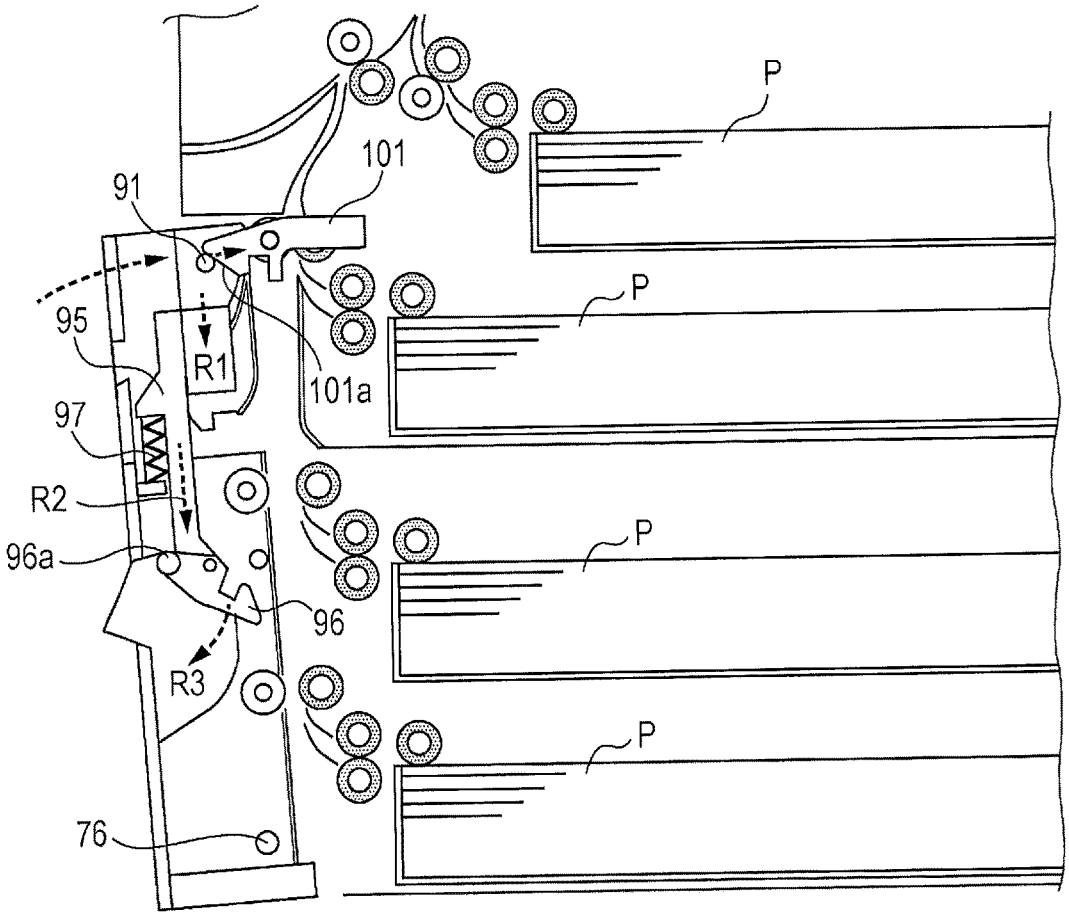
FIG. 8 is a cross-sectional schematic diagram of the first sheet-transport-path portion and the second sheet-transport-path portion in the state where a positioning boss of the first sheet-transport-path portion is in contact with a slope portion disposed on the image forming apparatus body as a result of performing an operation of closing the opening-closing member.
Figure 9:
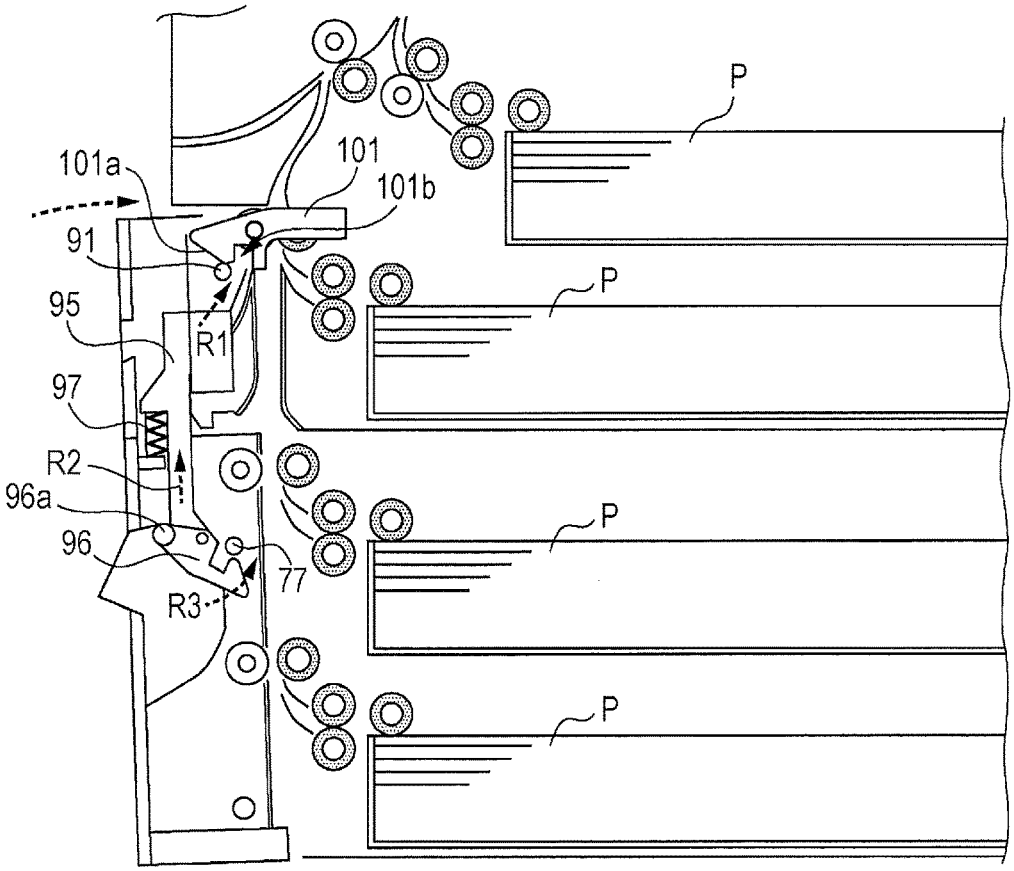
FIG. 9 is a cross-sectional schematic diagram of the first sheet-transport-path portion and the second sheet-transport-path portion in the state where the first sheet-transport-path portion is moving toward a rotation shaft of the opening-closing member as a result of performing an operation of closing the opening-closing member.
Figure 10:
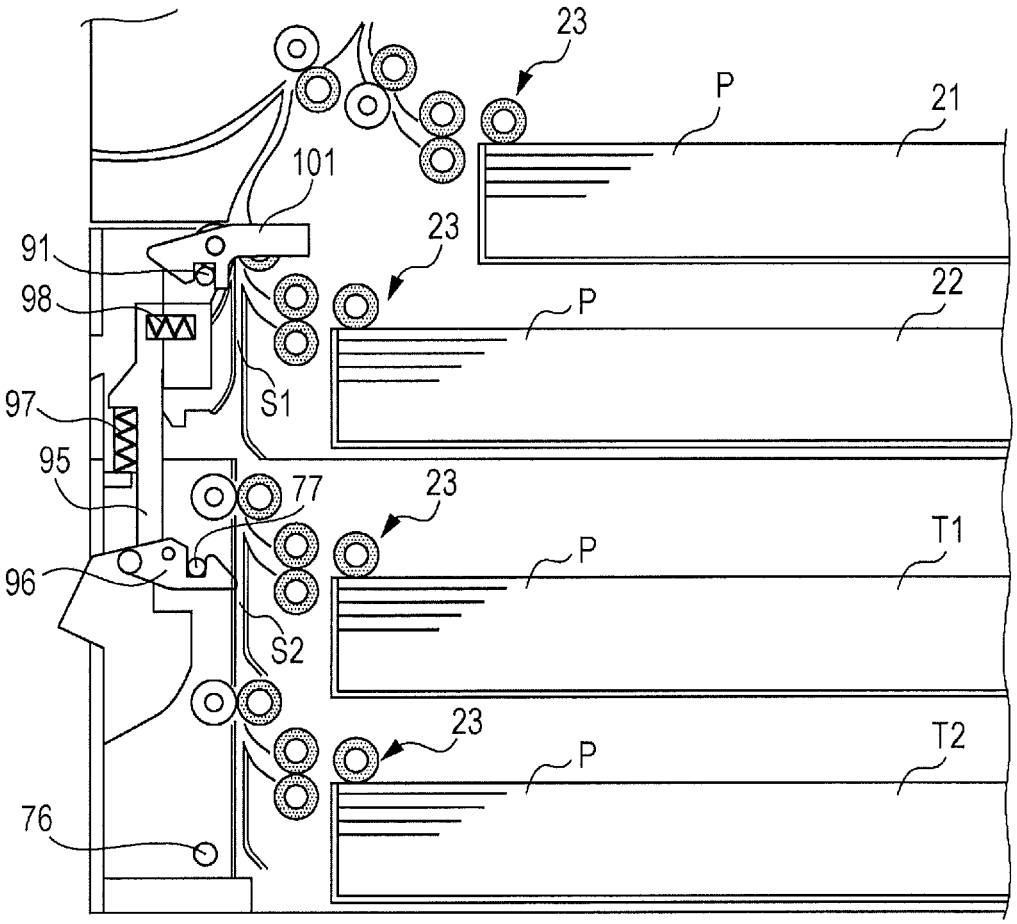
FIG. 10 is a cross-sectional schematic diagram of the first sheet-transport-path portion and the second sheet-transport-path portion in the state where the positions of the first sheet-transport-path portion and the second sheet-transport-path portion are determined with respect to the body of the image forming apparatus and the sheet transporting device as a result of performing an operation of closing the opening-closing member.

FIG. 5 is a perspective view of the configuration of the guide member 90 and link members 95 when viewed from the inner surface side of the opening-closing member 71. FIG. 6 is a cross-sectional schematic diagram of the first sheet-transport-path portion S1 and the second sheet-transport-path portion S2 that are in the state of being disengaged from the body of the image forming apparatus 1 as a result of operating the operating lever 72 of the opening-closing member 71. FIG. 7 is a vertical sectional schematic diagram of the first sheet-transport-path portion S1 and the second sheet-transport-path portion S2 that are in the open state. FIG. 8 is a cross-sectional schematic diagram of the first sheet-transport-path portion S1 and the second sheet-transport-path portion S2 in the state where a positioning boss 91 of the guide member 90 is in contact with a slope portion 101*a* of the body of the image forming apparatus 1 as a result of performing an operation of closing the opening-closing member 71. FIG. 9 is a cross-sectional schematic diagram of the first sheet-transport-path portion S1 and the second sheet-transport-path portion S2 in the state where the guide member 90 is moving toward the rotation shaft 76 of the opening-closing member 71 as a result of performing an operation of closing the opening-closing member 71. FIG. 10 is a cross-sectional schematic diagram of the first sheet-transport-path portion S1 and the second sheet-transport-path portion S2 in the state where the positions of the first sheet-transport-path portion S1 and the second sheet-transport-path portion S2 are determined with respect to the body of the image forming apparatus 1 and the sheet transporting device 70 as a result of performing an operation of closing the opening-closing member 71.

Referring now to the drawings, a jammed-sheet removal operation in the image forming apparatus 1 is described below.

(3.1) Configuration of Guide Member 90 and Link Members 95

As illustrated in FIG. 5, the guide member 90 includes positioning bosses 91, protruding in directions crossing the direction in which sheets are transported, so as to serve as guided objects.

First end portions of a pair of link members 95, serving as moving members, are engaged with both ends of the guide member 90. The link members 95 extend in the direction in which sheets are transported and second end portions of the link members 95 are rotatably connected to engaging members 96, which are engaged with engagement shafts 77, serving as engagement target portions and disposed on the sheet transporting device 70.

The operating lever 72 is rotatably connected to the engaging members 96. When the engaging members 96 are rotated around their rotation shafts 96*a* in response to the operation on the operating lever 72, the link members 95 connected to the engaging members 96 are moved downward (in the −Z direction, illustrated in FIG. 6).

Each link member 95 includes a coil spring 97, serving as an example of an urging member. The end of the coil spring 97 is supported by a receiving portion 78 (see FIG. 6) disposed on the inner surface side of the second opening-closing member 71B so that the guide member 90 is urged in a direction away from the rotation shaft 76 around which the opening-closing member 71 rotates.

Coil springs 98 are disposed on the inner surface side of the guide member 90 so as to urge the guide member 90 in the direction in which the opening-closing member 71 is opened or closed and so as to bring the pinch rollers 73*b* into contact with the driving rollers 73*a*. Thus, the pairs of transport rollers 73 are formed.

(3.2) Removal of Jammed Sheets

When, as illustrated in FIG. 6, the sheet transporting device 70 including the guide member 90 and the link members 95 having the above-described configuration is rotated by operating the operating lever 72 (see arrow R1 in FIG. 6), the engaging members 96 are rotated around the rotation shafts 96*a* (see arrow R2 in FIG. 6), so that the engaging members 96 that have been engaged with the engagement shafts 77 of the sheet transporting device 70, serving as engaged portions, become disengaged.

Concurrently with the rotation of the engaging members 96, the link members 95 rotatably connected to the engaging members 96 move downward or in the −Z direction while compressing the coil springs 97 (see arrow R3 in FIG. 6) and the guide member 90 engaged at the first end portions of the link members 95 also moves downward or in the −Z direction (see arrow R4 in FIG. 6). Thus, the positioning bosses 91 become disengaged from engaging members 101 disposed on the body of the image forming apparatus 1.

The opening-closing member 71 that has become disengaged from the sheet transporting device 70 and the body of the image forming apparatus 1 as a result of the rotational operation on the operating lever 72 is rotated around the rotation shaft 76 to the open position. Thus, the first sheet-transport-path portion S1 for sheets from the lower sheet tray 22 of the sheet-feeding device 20 and the second sheet-transport-path portion S2 for sheets from the sheet transporting device 70 are collectively opened, whereby removal of jammed sheets is facilitated (see FIG. 7)

(3.3) Operation of Closing Sheet-Transport-Path Portion

FIG. 8 illustrates the state where the positioning bosses 91 of the guide member 90 are in contact with the slope portions 101*a* on the body of the image forming apparatus 1 as a result of performing an operation of closing the opening-closing member 71.

When the opening-closing member 71 is rotated so as to be closed, the positioning bosses 91 of the guide member 90 move further toward the body of the image forming apparatus 1 together with the operation of closing the opening-closing member 71 and come into contact with the slope portions 101*a* of the engaging members 101 disposed on the body of the image forming apparatus 1, serving as guide portions on the apparatus body side.

When the opening-closing member 71, in this state, is further rotated, the guide member 90 moves downward or in the −Z direction (see arrow R1 in FIG. 8) and the link members 95 engaged with the guide member 90 move downward or in the −Z direction (see arrow R2 in FIG. 8) while compressing the coil springs 97.

The link members 95 rotate the engaging members 96 rotatably connected to the link members 95 (see arrow R3 in FIG. 8).

When the opening-closing member 71 is further rotated, as illustrated in FIG. 9, the positioning bosses 91 of the guide member 90 are moved by the urging force of the compressed coil springs 97 so as to be fitted into engagement recesses 101*h* after passing the slope portions 101*a* of the engaging members 101 of the body of the image forming apparatus 1 (see arrow R1 in FIG. 9).

Thus, the guide member 90 forming the first sheet-transport-path portion S1 on the body of the image forming apparatus 1 is capable of being securely positioned on the body of the image forming apparatus 1 by the operation of closing the opening-closing member 71 of the sheet transporting device 70.

The link members 95 engaged with the guide member 90 move upward or in the Z direction (see arrow R2 in FIG. 9) and the engaging members 96 connected to the link members 95 rotate so as to be fitted to the engagement shafts 77 disposed on the sheet transporting device 70 (see arrow R3 in FIG. 9).

The guide member 90 in which the positioning bosses 91 are positioned by the urging force of the coil springs 97 at the engaging members 101 on the body of the image forming apparatus 1 forms the first sheet-transport-path portion S1. The second sheet-transport-path portion S2 is formed so as to be continuous with the first sheet-transport-path portion S1 as a result of the engaging members 96 being engaged with the engagement shafts 77 disposed on the sheet transporting device 70.

The first sheet-transport-path portion S1 is held in the state of being capable of transporting a sheet by causing a magnetic member M1 (not illustrated), disposed on either the guide member 90 positioned at the engaging member 101 on the body of the image forming apparatus 1 or the body of the image forming apparatus 1, to attract with its magnetic force an attracted member M2 (not illustrated), disposed on the other one of the guide member 90 and the body of the image forming apparatus 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first sheet-transport-path portion that allows a sheet to be transported toward an image forming unit included in an image forming apparatus body;

a second sheet-transport-path portion that allows a sheet fed from sheet trays, holding sheets and vertically stacked in a plurality of rows one above another, to be transported toward the image forming apparatus body; and an opening-closing member supported so as to be movable around a rotation axis between an open position, in which the opening-closing member collectively opens the first sheet-transport-path portion and the second sheet-transport-path portion to an outside, and a closed position, in which the opening-closing member collectively closes the first sheet-transport-path portion and the second sheet-transport-path portion, wherein the first sheet-transport-path portion is supported by the opening-closing member, wherein, when the opening-closing member moves to the closed position, the first sheet-transport-path portion moves in a direction toward or away from the rotation axis of the opening-closing member, the direction crossing a direction in which the opening-closing member is opened or closed, and wherein, in the state where the opening-closing member is in the closed position, the first sheet-transport-path portion is engaged with the image forming apparatus body.

2. The image forming apparatus according to claim 1, wherein the rotation axis of the opening-closing member is disposed at an upstream end portion of the second sheet-transport-path portion in a sheet transport direction, and wherein the opening-closing member holds the first sheet-transport-path portion and the second sheet-transport-path portion in a state of allowing transportation of sheets by becoming engaged with an engagement target portion disposed at a downstream end portion of the second sheet-transport-path portion in the sheet transport direction.

3. The image forming apparatus according to claim 2, wherein the opening-closing member includes a moving member, which moves the first sheet-transport-path portion in a direction toward or away from the rotation axis, and an urging member, which urges the first sheet-transport-path portion in a direction away from the rotation axis, wherein the image forming apparatus body includes an body-side guide portion that guides the first sheet-transport-path portion in the direction toward or away from the rotation axis, wherein, when the opening-closing member moves to the closed position, a guided portion disposed on the first sheet-transport-path portion is guided by the body-side guide portion while touching the body-side guide portion and the first sheet-transport-path portion moves together with the moving member against an urging force of the urging member, and wherein, in the state where the opening-closing member is in the closed position, the guided portion is positioned as a result of coming into contact with a positioning portion.

4. The image forming apparatus according to claim 3, wherein the first sheet-transport-path portion is held in a state of allowing transportation of sheets by causing a magnetic member, disposed on either the first sheet-transport-path portion or the image forming apparatus body, to attract with a magnetic force an attracted member, disposed on the other one of the first sheet-transport-path portion and the image forming apparatus body.

5. The image forming apparatus according to claim 1, wherein the opening-closing member includes a moving member, which moves the first sheet-transport-path portion in a direction toward or away from the rotation axis, and an urging member, which urges the first sheet-transport-path portion in a direction away from the rotation axis, wherein the image forming apparatus body includes an body-side guide portion that guides the first sheet-transport-path portion in the direction toward or away from the rotation axis, wherein, when the opening-closing member moves to the closed position, a guided portion disposed on the first sheet-transport-path portion is guided by the body-side guide portion while touching the body-side guide portion and the first sheet-transport-path portion moves together with the moving member against an urging force of the urging member, and wherein, in the state where the opening-closing member is in the closed position, the guided portion is positioned as a result of coming into contact with a positioning portion.

6. The image forming apparatus according to claim 5, wherein the first sheet-transport-path portion is held in a state of allowing transportation of sheets by causing a magnetic member, disposed on either the first sheet-transport-path portion or the image forming apparatus body, to attract with a magnetic force an attracted member, disposed on the other one of the first sheet-transport-path portion and the image forming apparatus body.

7. The image forming apparatus according to claim 1, wherein the first sheet-transport-path portion is fixed to the opening-closing member and is detachable from the second sheet-transport-path portion.

* * * * *